US005288269A

United States Patent [19]

Hansen

[11] Patent Number: 5,288,269

[45] Date of Patent: Feb. 22, 1994

[54] CONTINUOUS IN-LINE METHOD OF FABRICATING A VARIABLE PITCH ROOF RIDGE VENT ASSEMBLY AND THE ASSEMBLY THEREOF

[75] Inventor: Jeffery E. Hansen, Chillicothe, Ill.

[73] Assignee: Air Vent, Inc., Peoria Heights, Ill.

[21] Appl. No.: 10,537

[22] Filed: Jan. 28, 1993

[51] Int. Cl.[5] ..... F24F 7/02

[52] U.S. Cl. ..... 454/365; 52/199

[58] Field of Search ..... 454/365, 364, 29, 72; 52/199

[56] References Cited

U.S. PATENT DOCUMENTS

| | | | |
|---|---|---|---|
| 2,214,183 | 9/1940 | Seymour | 454/365 |
| 2,416,284 | 2/1947 | Brown | 454/365 |
| 3,311,047 | 3/1967 | Smith et al. | 454/365 |
| 3,481,263 | 12/1969 | Belden | 98/42 |
| 3,660,955 | 5/1972 | Simon | 52/420 |
| 4,903,445 | 2/1990 | Mankowski | 52/199 |
| 5,122,095 | 6/1992 | Wolfert | 454/365 |

*Primary Examiner*—Henry A. Bennet
*Assistant Examiner*—William C. Doerrler
*Attorney, Agent, or Firm*—Silverman, Cass & Singer, Ltd.

[57] ABSTRACT

A continuous in-line method of fabricating a variable pitch roof ridge ventilator assembly and the assembly thereof including providing first and second elongate substantially rectangular panels formed into a desired configuration and connecting the panels by roll forming a flexible connecting cap member to a longitudinal upturned edge of each of the first and second panels where the flexible connecting member enables rotation between the first and second panels and provides a seal therebetween against infiltration of the elements or insects.

10 Claims, 2 Drawing Sheets

CONTINUOUS IN-LINE METHOD OF FABRICATING A VARIABLE PITCH ROOF RIDGE VENT ASSEMBLY AND THE ASSEMBLY THEREOF

BACKGROUND OF THE INVENTION

1. Field of the Invention

This invention relates generally to a roof ridge ventilator assembly and method of fabricating such an assembly, and more particularly to a continuous in-line method of fabricating a roof ridge ventilator assembly which can be adjusted during installation to accommodate a variety of different roof pitches and modified on-site to different lengths, closes off the interior of the roof from the elements and insects and enables venting of the space beneath the roof.

2. Description of the Related Art

Roof ridge ventilators are installed overlying the open ridge and along the length of a building roof for exhausting air from an attic or other space beneath the roof. These ventilators typically are utilized in conjunction with soffit ventilators to provide a ventilation system in which air is exhausted from the attic through the roof ridge ventilator and is replenished through the soffit ventilators.

Since roofs are constructed with different pitches and lengths, roof ridge ventilators preferably are adjustable on-site to accommodate the different pitches and lengths with a single type of ventilator. An example of an adjustable roof ridge ventilator is disclosed in U.S. Pat. No. 5,122,095 which is assigned to the same assignee as the assignee herein. That ventilator is formed in one piece and is adjustable for different pitches by bending the ventilator at its apex and for different lengths merely by cutting the ventilator with snips or the like.

Another type of adjustable roof ridge ventilator is illustrated in U.S. Pat. No. 3,481,263 which discloses a ridge type ventilator device including a pair of metal lateral sections which are connected by a hinge mechanism. The hinge mechanism includes a pair of hinge elements integrally formed with the lateral sections and a separate elongate circular hinge element having a slot within which the hinge elements of the lateral sections extend and rotate. Each lateral section also includes a pair of discrete imperforate metal end walls, one each affixed to an opposite end thereof.

Although such a ventilator is adjustable on-site to accommodate different roof pitches, it is provided completely assembled including end walls secured to each opposite end and thus appears to be manufactured at the factory for a specific length of roof. Such a ventilator can be quite long which, combined with its substantial height, is difficult and expensive to store, ship and handle.

Additionally, the hinge mechanism substantially is rigid which inhibits ease of manufacturing, especially in an in-line roll forming process, does not provide a tight seal against the elements between the connected lateral sections and, since it includes end walls attached at the factory, cannot be cut to a desired length on-site to accommodate roofs of different lengths. The ventilator also provides an undesirable high profile and requires a substantial amount of material and labor to fabricate.

It therefore would be desirable to provide a roof ridge ventilator assembly which readily and inexpensively can be manufactured in a continuous in-line operation with a minimum amount of material and labor and in predetermined lengths, can be adapted on-site to a variety of roof lengths, readily is adjustable to accommodate a variety of roof pitches and provides a seal against the elements and insects.

SUMMARY OF THE INVENTION

The invention provides a continuous in-line method of fabricating a variable pitch roof ridge ventilator assembly and the assembly thereof including providing first and second elongate substantially rectangular panels and forming the panels into a predetermined configuration. The panels then are connected with a flexible connecting cap member that is roll formed into engagement with a longitudinal upturned edge of each of the first and second panels so that the flexible connecting member enables rotation between the first and second panels and provides a seal therebetween against infiltration of the elements or insects.

DESCRIPTION OF THE PREFERRED EMBODIMENTS

Figure 1:
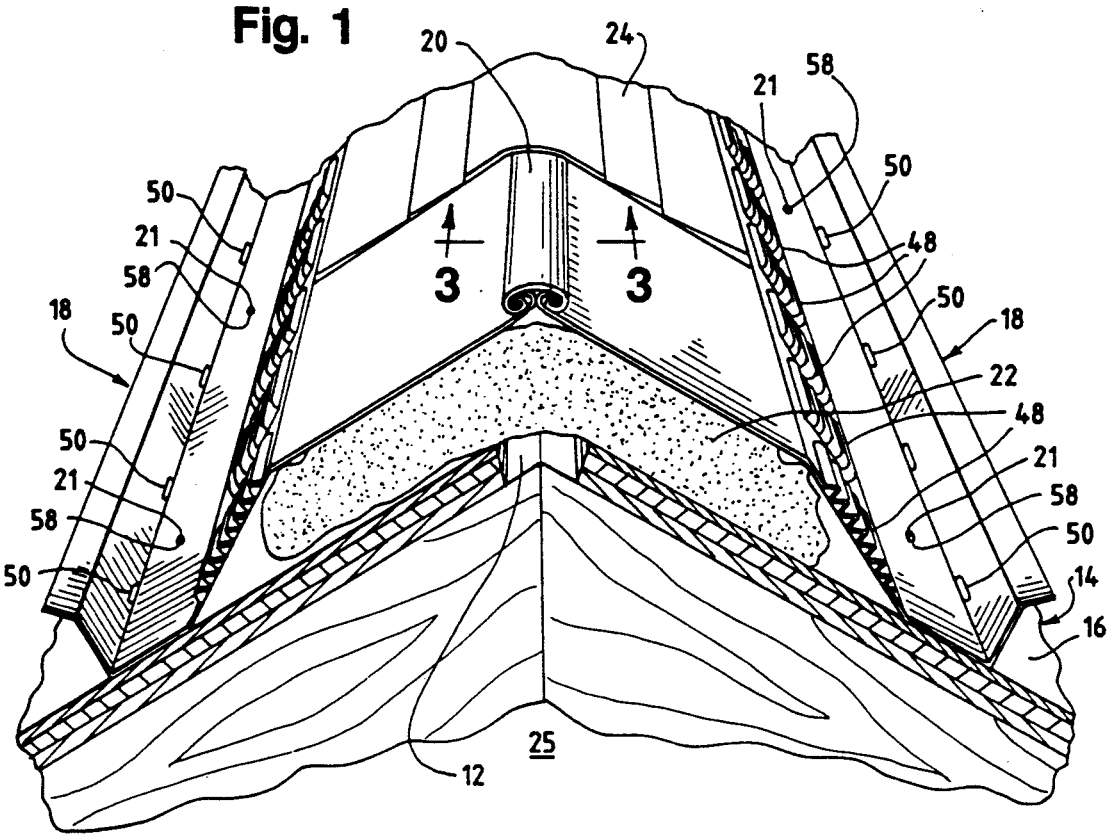
FIG. 1 is a perspective view of a length of a roof ridge ventilator assembly manufactured according to the method of the invention and mounted on a section of a roof.

Referring to FIG. 1, a roof ridge ventilator assembly embodying the invention generally is designated by the reference numeral 10. The assembly 10 typically is installed overlying an open ridge 12 of a building roof 14 having shingles 16 and is utilized in conjunction with a soffit ventilation system (not illustrated.) The ventilator assembly 10, however, can be utilized in a variety of roofing or similar venting applications if desired.

The assembly 10 includes two substantially identical ventilator members 18 which are rotatably interconnected by an enlongate flexible connecting cap 20. The ventilator members 18 preferably are formed from metal, such as aluminum, and have a predetermined length such as six, eight or ten feet, which can vary. The cap 20 preferably is formed from a flexible material, such as vinyl, rubber, plastic or any similar material so long as the desired connection, rotation and flexibility is provided.

A plurality of ventilator assemblies 10 typically are aligned end-to-end and connected to the roof 14 with fasteners 21, such as screws or the like, so that the entire length of the open ridge 12 is covered by ventilator assemblies 10. In order to inhibit infiltration of insects and the elements, a filter medium 22, such as a porous, nonwoven resilient fiberglass or similar material is secured to an inside surface of each of the ventilator members 18 prior to installation as will be described in detail hereinafter.

In order to match the shingles 16 of the remainder of the roof 14 and cover the seams between successive ventilator assemblies 10, the assemblies 10 can be shingled over with cap shingles 24. Thus, the low profile of the ventilator assembly 10 combined with the cap shingles 24 enables the ventilator assembly 10 to blend with the roof line to provide an aesthetically pleasing appearance. The cap shingles 24, however, can be omitted and the seams between successive assemblies 10 can be sealed in any desired way such as by overlapping a flange (not illustrated) between successive ventilator assemblies 10 or by including a separate cover or flashing member.

Briefly, in operation, a flow of air is established in the space beneath the roof 14, such as an attic 25 of a house. The ventilator assembly 10 enables heated air which rises within the attic 25 and through the open ridge 12 to escape through the ventilator assembly 10 to the exterior of the roof 14 while restricting the elements and insects from entering the attic 25 through the ventilator assembly 10. The escaping heated air from the attic 25 typically is replenished with outside air through soffit vents (not illustrated) installed within the soffit of the roof 14 or from any other air inlet source.

Figure 2:
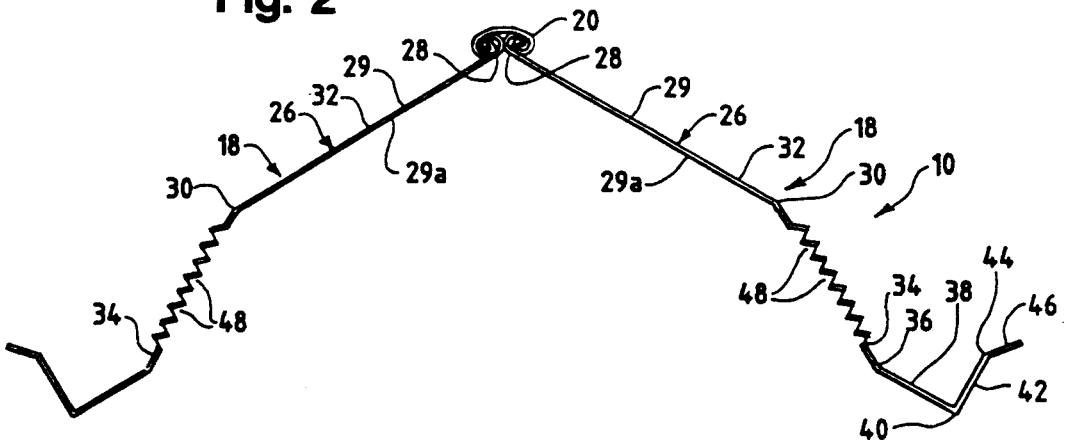
FIG. 2 is a cross-sectional view of the ventilator assembly of FIG. 1 without a filter.
Figure 6:
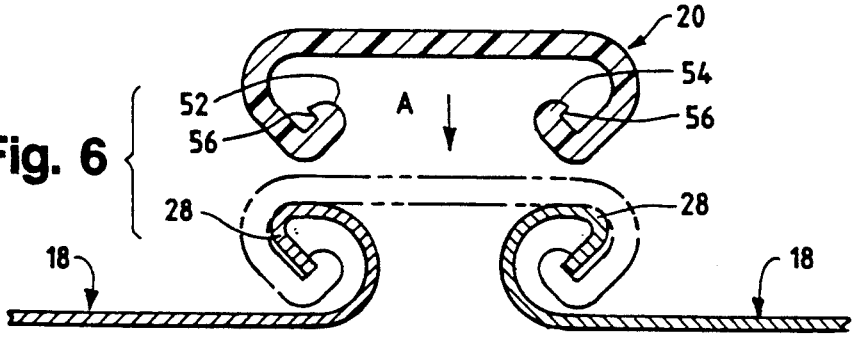
FIG. 6 is an enlarged fragmentary cross-sectional view of the ventilator assembly of the invention illustrating the cap separate from the ventilator members and, in dotted outline, the cap initially assembled thereto.

As FIGS. 1 and 2 illustrate, the ventilator members 18 are formed from aluminum, sheet metal or the like in an inline continuous operation to a predetermined length, width and shape. Each ventilator member 18 substantially is formed from a single panel or sheet 26 which can be embossed and includes an inside upturned longitudinal edge 28 which, as FIG. 6 illustrates, is formed into a substantially circular hook for cooperation with the cap 20.

Each panel 26 includes a top surface 29 and a bottom surface **29*a* and is bent longitudinally in four places to form the ventilator member 18. The first bend is positioned along a line 30 to form a first planar surface 32 and a second planar surface 34 formed at a first angle with respect to the first planar surface 32. The second bend is positioned along a line 36 to form a third planar surface 38 formed at a second angle with respect to the second planar surface 34**. Preferably, the first and second angles approximately are thirty degrees, but can vary.

The third bend is positioned along a line 40 to form a fourth planar surface 42 formed approximately at a ninety degree angle with respect to the third surface 38. Finally, the fourth bend is positioned along a line 44 to form a fifth planar surface 46 formed approximately at a forty-five degree angle with respect to the fourth surface 42.

To provide venting of air from the attic 25 through the ventilator members 18 to ambient atmosphere, the second planar surface 34 includes a plurality of louvers or slots 48 extending therethrough. Preferably, the louvers 48 have a predetermined length and are provided in sets of eight louvers each at various positions along the length of each ventilator member 18. The number, placement, size and shape of the louvers 48 can vary.

As FIG. 2 illustrates, in order to partially shield and provide a low pressure area in the vicinity of the louvers 48 and enhance exhaustion of air through the louvers 48, the fourth and fifth surfaces 42 and 46 form an upturned edge or baffle member. The upturned edge is selectively spaced from the louvers 48 to provide the desired low pressure area.

In order to prevent water from building up between the third planar surface 38 and the fourth planar surface 42, a plurality of weep holes or drain apertures 50 (illustrated in FIG. 1) can be formed through the fourth planar surface 42 of each ventilator member 18 proximate the third bend line 40. The size, spacing and shape of the weep holes 50 can vary so long as the desired draining is provided.

Figure 3:
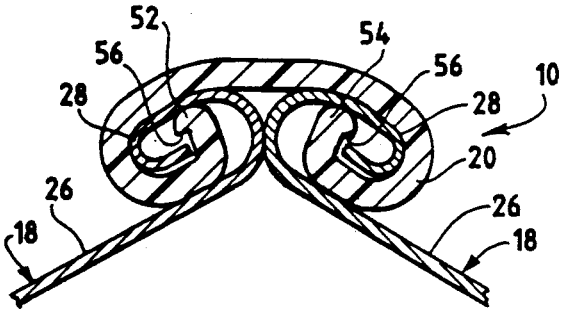
FIG. 3 is an enlarged fragmentary cross-sectional view of the ventilator assembly of the invention taken along line 3—3 of FIG. 1 and in the direction in dictated generally illustrating the ventilator assembly adjusted for use with a desired roof pitch.
Figure 4:
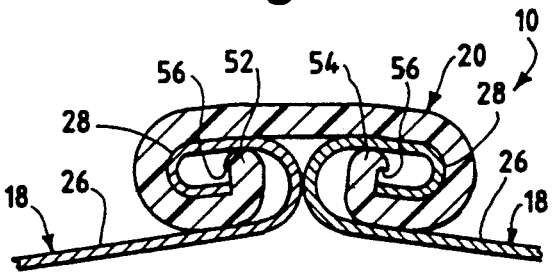
FIG. 4 is an enlarged fragmentary cross-sectional view of the ventilator assembly of the invention, similar to FIG. 3, illustrating the ventilator assembly adjusted for use with a roof pitch less than that of FIG. 3.

As FIGS. 3 and 4 illustrate, the cap 20 substantially is "C" shaped in cross-sectional configuration and engages the hooked edges 28 of each ventilator member 18 to form the finished assembly 10. The cap 20 includes first and second opposite ends 52 and 54, each of which include a shoulder 56.

Figure 7:
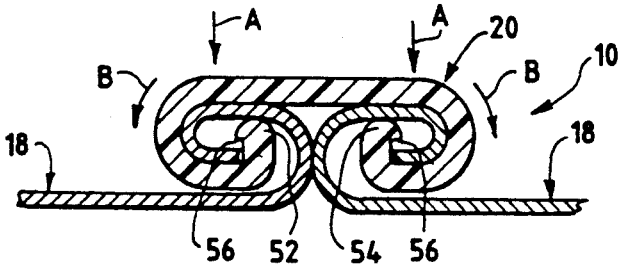
FIG. 7 is an enlarged fragmentary cross-sectional view of the ventilator assembly of the invention, similar to FIG. 6, illustrating the cap finally assembled to the ventilator members.

As FIGS. 6 and 7 illustrate, the particular design and materials of the cap 20 and the ventilator members 18 enables the cap 20 to be installed and the ventilator members 18 connected in an in-line roll forming operation. Such an operation enables automated assembly of the ventilator assembly 10 to substantially reduce manufacturing costs.

To install the cap 20, the cap 20 is fed into position above the hooked edges 2B of two ventilator members 18 that are positioned side by side as illustrated in FIG. 6. Upon initial movement of the cap 20 in the direction of arrow "A", the shoulders 56 of the first and second ends 52 and 54 simultaneously are rolled into engagement with the edges 28.

As FIG. 7 illustrates, upon further movement or pressure on the cap 20 by the roll forming machine in the direction of arrow "A", the circular hooked edges 28 of the ventilator members 18 are bent in the direction of arrows "B" into an oval configuration and lock the ends 52 and 54 of the cap 20 onto the edges 28. The ventilator members 18 then can be rotated with respect to each other without disengaging from the cap 20 to fit a relatively steep roof pitch, as illustrated in FIG. 3, or a relatively flat roof pitch, as illustrated in FIG. 4.

It is to be noted that flexibility of the cap 20 is important. As FIGS. 3 and 4 illustrate, adjustability between ventilator members 18 is provided in-part due to the flexibility of the cap 20. The motion between the cap 20 and the edges 28 is not purely rotational, but is a combination of rotation of the ventilator members 18 within the cap 20 and flexing of the cap 20.

For example, in rotating from the position illustrated in FIG. 3 to the position illustrated in FIG. 4, the oval shape of the hooked edges 28 tends to force the ventilator members 18 slightly apart. This movement is accommodated due to the flexibility of the cap 20.

Additionally, the roll forming operation utilized to bend the edges 28 as illustrated in FIG. 7 is possible due to the flexibility of the cap 20. If the cap 20 were made of a rigid material, such as metal, it would be difficult to bend the edges 28 through the rigid cap without also distorting the rigid cap and possibly limiting its effectiveness.

The flexibility of the cap 20 also is important in order to provide a tight seal against the elements, such as wind, rain and snow, as well as insects. The cooperation between the flexible cap 20, which preferably is made of vinyl, and metal ventilator members 18 provides the desired tight seal even if the ventilator members 18 are embossed.

Figure 5:
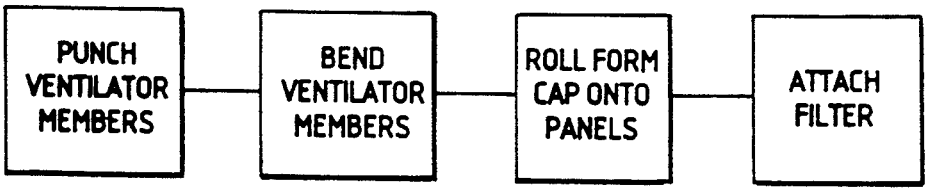
FIG. 5 is a schematic block diagram illustrating the in-line continuous method of manufacturing the ventilator assembly of the invention.

FIG. 5 illustrates the in-line continuous method utilized to from the ventilator assembly 10. First, ventilator members 18 are punched in a press or the like to form the louvers 48, weep holes 50 and, if desired, apertures 58 for the fasteners 21. The ventilators 18 can be punched one at a time or two or more ventilators 18 can be punched simultaneously.

Next, the ventilator members 18 are bent to form the hook edges 28 and the bend lines 30, 36, 40 and 44 to inturn form the planar surfaces 32, 34, 38, 42 and 46. The bends 28, 30, 36, 40 and 44 can be performed individually or simultaneously and in any order.

Two ventilator members 18 then are aligned with their hook edges 28 facing each other and spaced a predetermined distance apart as illustrated in FIG. 6. The first and second ends 52 and 54 of the cap 20 then are rolled into initial engagement with the edges 28.

The edges 28 then are bent into the position illustrated in FIG. 7 to connect the cap 20 to the ventilator members 18. If desired, the initial engagement and bending of the edges 28 can be done simultaneously. To complete the assembly 10, the filter 22 then is adhered to the bottom or inside surface 29*a* of the ventilator member 18 to cover the louvers 48.

Modifications and variations of the present invention are possible in the light of the above teachings. A specific dimension, material or construction is not required so long as the assembled device functions as herein described. It therefore is to be understood that within the scope of the appended claims, the invention may be practiced otherwise than as specifically described.

What is claimed and desired to be secured by letters patent is:

1. A continuous in-line method of fabricating a variable pitch roof ridge ventilator assembly, comprising the steps of:

providing a plurality of elongate substantially rectangular panels, each panel having a predetermined length and width, top and bottom opposite planar surfaces, first and second opposite ends and first and second opposite elongate sides;

conveying said panels to punch press means;

punching a plurality of louvers, weep holes and fastener apertures with said punch pres means at predetermined positions along the length of said panels;

conveying said panels to panel bending means;

bending an edge of said first elongate side of each panel toward said top surface thereof and substantially into a hook shape along the entire length of each panel;

bending an edge of said second elongate side of each panel toward said top surface thereof to maintain a predetermined angle with respect to said top surface;

arranging first and second panels of said plurality of panels parallel to each other with said first elongate side of each panel in face-to-face registry and positioned a predetermined distance apart;

conveying said arranged panels to roll forming means;

roll forming a flexible connecting cap member to each of said hook portions of said first and second panels by initially engaging respective portions of said connecting member to said hook portions and then deforming said hook portions to connect said connecting member thereto, said flexible connecting member enabling rotational movement between said first and second panels and providing a seal therebetween against infiltration of the elements and insects.

2. The method as defined in claim 1 wherein said step of roll forming includes deforming said hook portions by applying a force thereto which extends through said cap member without permanently deforming said cap member and detracting from its effectiveness.

3. A variable pitch roof ridge ventilator assembly to be installed overlying the open ridge and along a portion of the length of the roof of a building which directs the flow of air from the interior of the building to the exterior of the building, comprising:

first and second elongate panels, each panel having a predetermined length and width, top and bottom opposite planar surfaces, a plurality of venting louvers formed therethrough, a first upturned edge formed along a longitudinal side of said panels and extending toward the center of said top surface of said panels and forming hook portions thereon and a second upturned edge formed along the opposite longitudinal side of said panels on said top surface of said panels to shield at least a portion of said louvers; and flexible cap means for enabling initial attachment of said cap means to said hook portions of said first and second panels, for enabling deformation of said hook portions after said initial attachment without permanently deforming said flexible cap means to securely interconnect said first and second panels, for enabling rotation between said first and second panels after connected by flexing of said flexible cap means and for providing a seal between said panels when connected to restrict the elements from infiltrating between said flexible cap means and said panels so that said first and second panels can be connected and rotated to a desired angle to accommodate roof ridges having a variety of pitches.

4. A variable pitch roof ridge ventilator assembly to be installed overlying the open ridge and along a portion of the length of the roof of a building which directs the flow of air from the interior of the building to the exterior of the building, comprising:

first and second elongate panels, each panel having a predetermined length and width, top and bottom opposite planar surfaces, a plurality of venting louvers formed therethrough, a first upturned edge formed along a longitudinal side of said panels and extending toward the center of said top surface of said panels and forming hook portions thereon and a second upturned edge formed along the opposite longitudinal side of said panels on said top surface of said panels to shield at least a portion of said louvers; and flexible cap means capable of being attached in a roll forming operation for enabling initial attachment of said cap means to said hook portions of said first and second panels, for enabling deformation of said hook portions after said initial attachment to securely interconnect said first and second panels, for enabling rotation between said first and second panels after connected and for providing a seal between said panels when connected so that said first and second panels can be connected and rotated to a desired angle to accommodate roof ridges having a variety of pitches.

5. A variable pitch roof ridge ventilator assembly to be installed overlying the open ridge and along a portion of the length of the roof of a building which directs the flow of air from the interior of the building to the exterior of the building, comprising:

first and second elongate panels, each panel having a predetermined length and width, top and bottom opposite planar surfaces, a plurality of venting louvers formed therethrough, a first upturned edge formed along a longitudinal side of said panels and extending toward the center of said top surface of said panels and forming hook portions thereon and a second upturned edge formed along the opposite longitudinal side of said panels on said top surface of said panels to shield at least a portion of said louvers; and flexible elongate cap means substantially "c" shaped in cross-sectional configuration including first and second opposite ends, each end including a shoulder formed thereon, for enabling initial attachment of said cap means to said hook portions of said first and second panels, for enabling deformation of said hook portions after said initial attachment to securely interconnect said first and second panels, for enabling rotation between said first and second panels after connected and for providing a seal between said panels when connected so that said first and second panels can be connected and rotated to a desired angle to accommodate roof ridges having a variety of pitches.

6. The ventilator assembly as defined in claim 4 wherein said flexible cap means provide for deformation of said hook portions of said elongate panels through said cap means without permanently deforming said cap means or detracting from their effectiveness.

7. The ventilator assembly as defined in claim 5 wherein said first and second panels are formed from aluminum and said flexible cap member is made of vinyl.

8. The ventilator assembly as defined in claim 7 wherein said aluminum is embossed.

9. The method as defined in claim 1 including connecting a filter member to said bottom surface of said first and second panels to cover said louvers formed therethrough.

10. The ventilator assembly as defined in claim 3 including a filter member connected to said bottom surface of each of said first and second panels to cover said louvers formed therethrough.

* * * * *